US007991166B2

(12) United States Patent
Kihara et al.

(10) Patent No.: US 7,991,166 B2
(45) Date of Patent: Aug. 2, 2011

(54) MICROPHONE APPARATUS

(75) Inventors: Nobuyuki Kihara, Tokyo (JP); Yoshikazu Takahashi, Saitama (JP); Yasuhiko Kato, Tokyo (JP)

(73) Assignee: Sony Corporation, Tokyo (JP)

( * ) Notice: Subject to any disclaimer, the term of this patent is extended or adjusted under 35 U.S.C. 154(b) by 1211 days.

(21) Appl. No.: 11/353,088

(22) Filed: Feb. 14, 2006

(65) Prior Publication Data

US 2006/0188111 A1 Aug. 24, 2006

(30) Foreign Application Priority Data

Feb. 24, 2005 (JP) ..... 2005-048542

(51) Int. Cl.
*H04R 3/00* (2006.01)
*H04R 1/02* (2006.01)
*G10L 11/00* (2006.01)
*G10L 19/00* (2006.01)

(52) U.S. Cl. ..... 381/92; 381/122; 381/91; 381/111; 704/200; 704/201; 704/231

(58) Field of Classification Search ..... 381/91, 381/92, 356, 111, 122, 1, 312–314, 17–19; 181/145; 348/14.1; 379/66, 406.02, 406.03; 704/200, 201, 225, 226, 233
See application file for complete search history.

(56) References Cited

U.S. PATENT DOCUMENTS 4,653,606 A * 3/1987 Flanagan ..... 181/145
5,335,011 A * 8/1994 Addeo et al. ..... 348/14.1

FOREIGN PATENT DOCUMENTS

JP 2001-231089 * 8/2001
JP 2001231089 A * 8/2001
JP 2002-271885 * 9/2002
JP 2002271885 A * 9/2002

* cited by examiner

*Primary Examiner* — Devona E Faulk
(74) *Attorney, Agent, or Firm* — Oblon, Spivak, McClelland, Maier & Neustadt, L.L.P.

(57) ABSTRACT

A microphone apparatus for processing and outputting an output signal of a microphone array including at least nine microphones includes a directivity function processing circuit that converts the output signal of the microphone array into a unidirectional signal and that outputs the unidirectional signal. The directivity function processing circuit expands a directivity function whose variable is an incident angle of an acoustic wave into a Fourier series up to at least third order. The variable in the expanded expression is produced from output signals of the microphones forming the microphone array.

6 Claims, 17 Drawing Sheets

FIG. 1

$$y(t) = x(t)D(\theta,\omega) \quad \cdots (1)$$

- y(t) : OUTPUT CHARACTERISTIC OF MICROPHONE
- D(θ, ω) : TRANSFER CHARACTERISTIC OF MICROPHONE
- x(t) : INPUT ACOUSTIC WAVE
- θ : INCIDENT ANGLE OF ACOUSTIC WAVE (DIRECTION OF SOUND SOURCE)
- ω : ANGULAR FREQUENCY OF ACOUSTIC WAVE $$y(t) = \sum_{n=1}^{N} x_{\theta_n}(t)D(\theta_n,\omega) \quad \cdots (2)$$

- xθn(t) : ACOUSTIC WAVE FROM SOUND SOURCE n
- θn : DIRECTION OF SOUND SOURCE n

FIG. 2A

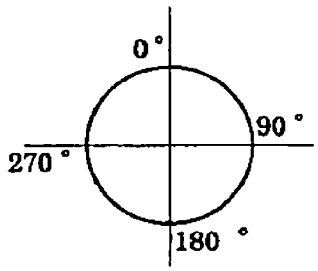

$D(\theta,\omega) = 1$

FIG. 2B

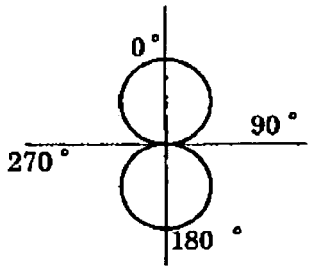

$D(\theta,\omega) = \cos\theta$

FIG. 3

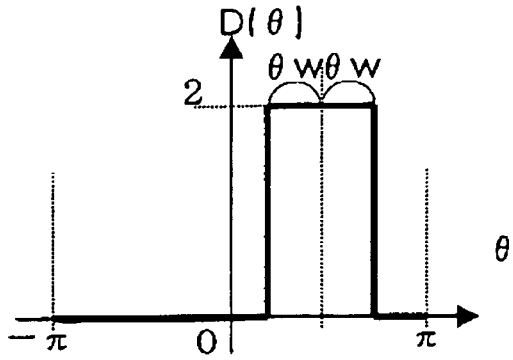

FIG. 4

$$D(\theta,\omega) = a_0 + \sum_{n=1}^{\infty}(a_n \cos n\theta + b_n \sin n\theta) \quad \cdots (3)$$

WITH $$a_0 = \frac{2\theta_w}{\pi}$$

$$a_n = \frac{2}{n\pi}\{\sin n(\theta_c + \theta_w) - \sin n(\theta_c - \theta_w)\}$$

$$b_n = \frac{2}{n\pi}\{\cos n(\theta_c - \theta_w) - \cos n(\theta_c + \theta_w)\}$$

$$\begin{aligned} D(\theta,\omega) = {} & \frac{2\theta_w}{\pi} \\ & + \frac{2}{\pi}\{\sin(\theta_c + \theta_w) - \sin(\theta_c - \theta_w)\}\cos\theta \\ & + \frac{2}{\pi}\{\cos(\theta_c - \theta_w) - \cos(\theta_c + \theta_w)\}\sin\theta \\ & + \frac{1}{\pi}\{\sin 2(\theta_c + \theta_w) - \sin 2(\theta_c - \theta_w)\}\cos 2\theta \\ & + \frac{1}{\pi}\{\cos 2(\theta_c - \theta_w) - \cos 2(\theta_c + \theta_w)\}\sin 2\theta \\ & + \frac{2}{3\pi}\{\sin 3(\theta_c + \theta_w) - \sin 3(\theta_c - \theta_w)\}\cos 3\theta \\ & + \frac{2}{3\pi}\{\cos 3(\theta_c - \theta_w) - \cos 3(\theta_c + \theta_w)\}\sin 3\theta \quad \cdots (4) \end{aligned}$$

$$x(t) = e^{j\omega t} \quad \cdots (5)$$

$$\begin{aligned} y(t) &= x_{M4}(t) D(\theta, \omega) \\ &= x_{M4}(t) \left\{ a_0 + \sum_{n=1}^{\infty} (a_n \cos n\theta + b_n \sin n\theta) \right\} \\ &= a_0 x_{M4}(t) \\ &\quad + a_1 x_{M4}(t) \cos\theta + b_1 x_{M4}(t) \sin\theta \\ &\quad + a_2 x_{M4}(t) \cos 2\theta + b_2 x_{M4}(t) \sin 2\theta \\ &\quad + a_3 x_{M4}(t) \cos 3\theta + b_3 x_{M4}(t) \sin 3\theta \quad \cdots (6) \end{aligned}$$

FIG. 8

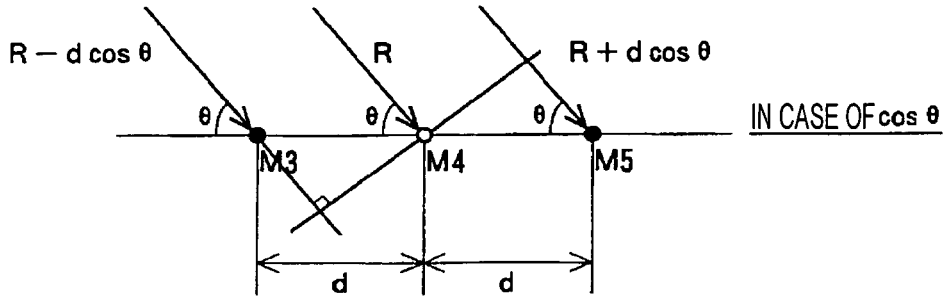

$$\left.\begin{aligned} x_{M3}(t) &= e^{j(\omega t-\omega\frac{R-d\cos\theta}{c})} \\ x_{M4}(t) &= e^{j(\omega t-\omega\frac{R}{c})} \\ x_{M5}(t) &= e^{j(\omega t-\omega\frac{R+d\cos\theta}{c})} \end{aligned}\right\} \cdots (7)$$

$$\begin{aligned} x_{M3}(t)-x_{M5}(t) &= e^{j(\omega t-\omega\frac{R-d\cos\theta}{c})} - e^{j(\omega t-\omega\frac{R+d\cos\theta}{c})} \\ &= e^{j(\omega t-\omega\frac{R}{c})}\left\{e^{j\frac{\omega d}{c}\cos\theta} - e^{-j\frac{\omega d}{c}\cos\theta}\right\} \\ &= e^{j(\omega t-\omega\frac{R}{c})}\left\{j2\sin(\tfrac{\omega d}{c}\cos\theta)\right\} \qquad \cdots (8) \end{aligned}$$

$$\begin{aligned} x_{M3}(t)-x_{M5}(t) &\cong e^{j(\omega t-\omega\frac{R}{c})}\left\{\tfrac{2j\omega d}{c}\cos\theta\right\} \\ &= x_{M4}(t)\left\{\tfrac{2j\omega d}{c}\cos\theta\right\} \qquad \cdots (9) \end{aligned}$$

$$\therefore x_{M4}(t)\cos\theta = \frac{c}{2j\omega d}\left\{x_{M3}(t)-x_{M5}(t)\right\} \qquad \cdots (10)$$

FIG. 9

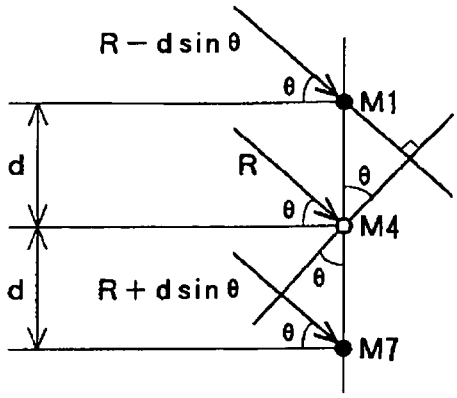

IN CASE OF sin θ

$$\left.\begin{aligned} x_{M1}(t) &= e^{j(\omega t-\omega\frac{R-d\sin\theta}{c})} \\ x_{M4}(t) &= e^{j(\omega t-\omega\frac{R}{c})} \\ x_{M7}(t) &= e^{j(\omega t-\omega\frac{R+d\sin\theta}{c})} \end{aligned}\right\} \cdots (11)$$

$$\begin{aligned} x_{M1}(t)-x_{M7}(t) &= e^{j(\omega t-\omega\frac{R-d\sin\theta}{c})} - e^{j(\omega t-\omega\frac{R+d\sin\theta}{c})} \\ &= e^{j(\omega t-\omega\frac{R}{c})}\left\{e^{j\frac{\omega d}{c}\sin\theta} - e^{-j\frac{\omega d}{c}\sin\theta}\right\} \\ &= e^{j(\omega t-\omega\frac{R}{c})}\left\{j2\sin(\tfrac{\omega d}{c}\sin\theta)\right\} \end{aligned} \cdots (12)$$

$$\begin{aligned} x_{M1}(t)-x_{M7}(t) &\cong e^{j(\omega t-\omega\frac{R}{c})}\left\{\tfrac{2j\omega d}{c}\sin\theta\right\} \\ &= x_{M4}(t)\left\{\tfrac{2j\omega d}{c}\sin\theta\right\} \end{aligned} \cdots (13)$$

$$\therefore x_{M4}(t)\sin\theta = \frac{c}{2j\omega d}\left\{x_{M1}(t)-x_{M7}(t)\right\} \cdots (14)$$

FIG. 10

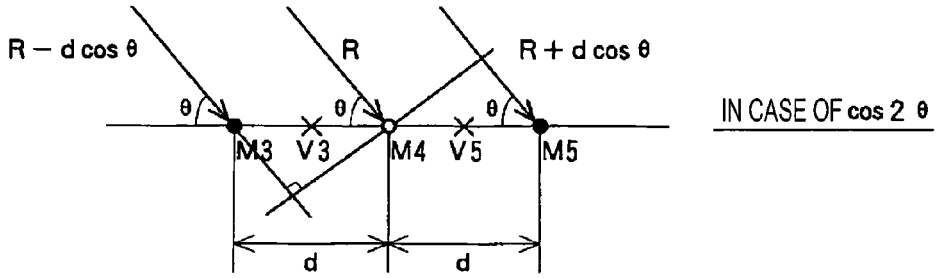

$$x_{V3}(t)\cos\theta = \frac{c}{2j\omega\frac{1}{2}d}\{x_{M3}(t) - x_{M4}(t)\} \quad \cdots (15)$$

$$x_{V5}(t)\cos\theta = \frac{c}{2j\omega\frac{1}{2}d}\{x_{M4}(t) - x_{M5}(t)\} \quad \cdots (16)$$

$$\{x_{V3}(t) - x_{V5}(t)\}\cos\theta = \frac{c}{2j\omega\frac{1}{2}d}\{x_{M3}(t) - 2x_{M4}(t) + x_{M5}(t)\} \quad \cdots (17)$$

$$x_{M4}(t)\cos\theta = \frac{c}{2j\omega\frac{1}{2}d}\{x_{V3}(t) - x_{V5}(t)\} \quad \cdots (18)$$

$$x_{M4}(t)\cos^2\theta = \left(\frac{c}{2j\omega\frac{1}{2}d}\right)^2\{x_{M3}(t) - 2x_{M4}(t) + x_{M5}(t)\} \quad \cdots (19)$$

$$\cos 2\theta = 2\cos^2\theta - 1 \quad \cdots (20)$$

$$\begin{aligned} x_{M4}(t)\cos 2\theta &= x_{M4}(t)(2\cos^2\theta - 1) \\ &= 2x_{M4}(t)\cos^2\theta - x_{M4}(t) \end{aligned} \quad \cdots (21)$$

$$\therefore x_M(t)\cos 2\theta = 2\left(\frac{c}{2j\omega\frac{1}{2}d}\right)^2\{x_{M3}(t) - 2x_{M4}(t) + x_{M5}(t)\} - x_{M4}(t) \quad \cdots (22)$$

FIG. 11

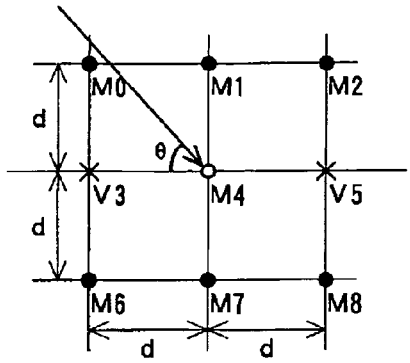

IN CASE OF sin 2 θ

$$x_{V3}(t)\sin\theta = \frac{c}{2j\omega d}\{x_{M0}(t) - x_{M6}(t)\} \quad \cdots (23)$$

$$x_{V5}(t)\sin\theta = \frac{c}{2j\omega d}\{x_{M2}(t) - x_{M8}(t)\} \quad \cdots (24)$$

$$\{x_{V3}(t) - x_{V5}(t)\}\sin\theta = \frac{c}{2j\omega d}\{x_{M0}(t) - x_{M6}(t) - x_{M2}(t) + x_{M8}(t)\} \quad \cdots (25)$$

$$x_{M4}(t)\cos\theta = \frac{c}{2j\omega d}\{x_{V3}(t) - x_{V5}(t)\} \quad \cdots (26)$$

$$\sin 2\theta = 2\sin\theta\cos\theta \quad \cdots (27)$$

$$x_{M4}(t)\sin\theta\cos\theta = \left(\frac{c}{2j\omega d}\right)^2\{x_{M0}(t) - x_{M6}(t) - x_{M2}(t) + x_{M8}(t)\} \quad \cdots (28)$$

$$\therefore x_{M4}(t)\sin 2\theta = 2\left(\frac{c}{2j\omega d}\right)^2\{x_{M0}(t) - x_{M6}(t) - x_{M2}(t) + x_{M8}(t)\} \quad \cdots (29)$$

FIG. 12

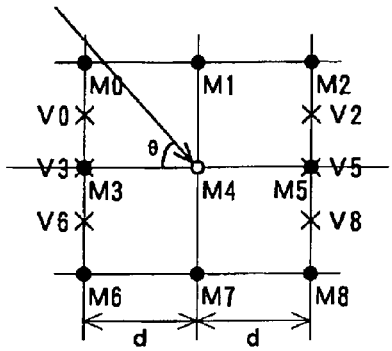

IN CASE OF cos 3 θ

$$x_{V0}(t)\sin\theta = \frac{c}{2j\omega\frac{1}{2}d}\{x_{M0}(t) - x_{M3}(t)\} \quad \cdots (30)$$

$$x_{V6}(t)\sin\theta = \frac{c}{2j\omega\frac{1}{2}d}\{x_{M3}(t) - x_{M6}(t)\} \quad \cdots (31)$$

$$\{x_{V0}(t) - x_{V6}(t)\}\sin\theta = \frac{c}{2j\omega\frac{1}{2}d}\{x_{M0}(t) - 2x_{M3}(t) + x_{M6}(t)\} \quad \cdots (32)$$

$$x_{V3}(t)\sin\theta = \frac{c}{2j\omega\frac{1}{2}d}\{x_{V0}(t) - x_{V6}(t)\} \quad \cdots (33)$$

$$x_{V3}(t)\sin^2\theta = \left(\frac{c}{2j\omega\frac{1}{2}d}\right)^2\{x_{M0}(t) - 2x_{M3}(t) + x_{M6}(t)\} \quad \cdots (34)$$

$$x_{V5}(t)\sin^2\theta = \left(\frac{c}{2j\omega\frac{1}{2}d}\right)^2\{x_{M2}(t) - 2x_{M5}(t) + x_{M8}(t)\} \quad \cdots (35)$$

$$x_{M4}(t)\sin^2\theta\cos\theta = \left(\frac{c}{2j\omega\frac{1}{2}d}\right)^3\{x_{M0}(t) - 2x_{M3}(t) + x_{M6}(t) - x_{M2}(t) + 2x_{M5}(t) - x_{M8}(t)\} \cdots (36)$$

$$\cos 3\theta = \cos\theta - 4\sin^2\theta\cos\theta \quad \cdots (37)$$

$$\therefore x_{M4}(t)\cos 3\theta = \frac{c}{2j\omega d}\{x_{M3}(t) - x_{M5}(t)\} - 4\left(\frac{c}{2j\omega\frac{1}{2}d}\right)^3\{x_{M0}(t) - 2x_{M3}(t) + x_{M6}(t) - x_{M2}(t) + 2x_{M5}(t) - x_{M8}(t)\} \quad \cdots (38)$$

FIG. 13

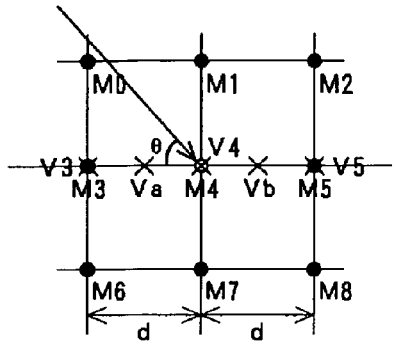

IN CASE OF sin 3 θ

$$x_{V3}(t)\sin\theta = \frac{c}{2j\omega d}\{x_{M0}(t) - x_{M6}(t)\} \quad \cdots (39)$$

$$x_{V4}(t)\sin\theta = \frac{c}{2j\omega d}\{x_{M1}(t) - x_{M7}(t)\} \quad \cdots (40)$$

$$x_{V5}(t)\sin\theta = \frac{c}{2j\omega d}\{x_{M2}(t) - x_{M8}(t)\} \quad \cdots (41)$$

$$x_{Va}(t)\cos\theta\sin\theta = \frac{c}{2j\omega d}\frac{c}{2j\omega\frac{1}{2}d}\{x_{M0}(t) - x_{M6}(t) - x_{M1}(t) + x_{M7}(t)\} \quad \cdots (42)$$

$$x_{Va}(t)\cos\theta\sin\theta = \frac{c}{2j\omega d}\frac{c}{2j\omega\frac{1}{2}d}\{x_{M1}(t) - x_{M7}(t) - x_{M2}(t) + x_{M8}(t)\} \quad \cdots (43)$$

$$x_{M4}(t)\cos^2\theta\sin\theta = \frac{c}{2j\omega d}\left(\frac{c}{2j\omega\frac{1}{2}d}\right)^2\{x_{M0}(t) - x_{M6}(t) - 2x_{M1}(t) + 2x_{M7}(t) + x_{M2}(t) - x_{M8}(t)\} \quad \cdots (44)$$

$$\sin 3\theta = 4\cos^2\theta\sin\theta - \sin\theta \quad \cdots (45)$$

$$\therefore x_{M4}(t)\sin 3\theta = 4\frac{c}{2j\omega d}\left(\frac{c}{2j\omega\frac{1}{2}d}\right)^2\{x_{M0}(t) - x_{M6}(t) - 2x_{M1}(t) + 2x_{M7}(t) + x_{M2}(t) - x_{M8}(t)\} - \frac{c}{2j\omega d}\{x_{M3}(t) - x_{M5}(t)\} \quad \cdots (46)$$

FIG. 14

$$
\begin{aligned}
y(t) &= x_{M4}(t)D(\theta,\omega) \\
&= a_0 x_{M4}(t) \\
&+ a_1 \frac{c}{2j\omega d}\{x_{M3}(t) - x_{M5}(t)\} \\
&+ b_1 \frac{c}{2j\omega d}\{x_{M1}(t) - x_{M7}(t)\} \\
&+ a_2 2\left(\frac{c}{2j\omega\frac{1}{2}d}\right)^2\{x_{M3}(t) - 2x_{M4}(t) + x_{M5}(t)\} - a_2 x_{M4}(t) \\
&+ b_2 2\left(\frac{c}{2j\omega d}\right)^2\{x_{M0}(t) - x_{M6}(t) - x_{M2}(t) + x_{M8}(t)\} \\
&+ a_3 \frac{c}{2j\omega d}\{x_{M3}(t) - x_{M5}(t)\} \\
&- a_3 4\left(\frac{c}{2j\omega\frac{1}{2}d}\right)^3\{x_{M0}(t) - 2x_{M3}(t) + x_{M6}(t) - x_{M2}(t) + 2x_{M5}(t) - x_{M8}(t)\} \\
&+ b_3 4\frac{c}{2j\omega d}\left(\frac{c}{2j\omega\frac{1}{2}d}\right)^2\{x_{M0}(t) - x_{M6}(t) - 2x_{M1}(t) + 2x_{M7}(t) + x_{M2}(t) - x_{M8}(t)\} \\
&- b_3 \frac{c}{2j\omega d}\{x_{M3}(t) - x_{M5}(t)\} \qquad \cdots (47)
\end{aligned}
$$

$$
\begin{cases}
a_0 = \dfrac{2\theta_w}{\pi} \\
a_n = \dfrac{2}{n\pi}\{\sin n(\theta_c + \theta_w) - \sin n(\theta_c - \theta_w)\} \\
b_n = \dfrac{2}{n\pi}\{\cos n(\theta_c - \theta_w) - \cos n(\theta_c + \theta_w)\}
\end{cases}
$$

$$n = 1 \sim 3$$

FIG. 19

$$\cos 2\theta = \sin\left(2\theta + \frac{\pi}{2}\right)$$

$$= \sin 2\left(\theta + \frac{\pi}{4}\right) \quad \cdots (48)$$

$$\phi = \theta + \frac{\pi}{4} \quad \cdots (49)$$

$$\cos 2\theta = \sin 2\phi \quad \cdots (50)$$

$$x_{M4}(t)\sin 2\theta = 2\left(\frac{c}{2j\omega d}\right)^2 \left\{x_{M0}(t) - x_{M6}(t) - x_{M2}(t) + x_{M8}(t)\right\} \quad \cdots (29)$$

$$x_{M4}(t)\sin 2\phi = 2\left(\frac{c}{2j\omega d}\right)^2 \left\{x_{V0}(t) - x_{V6}(t) - x_{V2}(t) + x_{V8}(t)\right\} \quad \cdots (51)$$

$$x_{M4}(t)\sin 2\phi = 2\left(\frac{c}{\sqrt{2}j\omega d}\right)^2 \left\{x_{M3}(t) - x_{M7}(t) - x_{M1}(t) + x_{M5}(t)\right\} \quad \cdots (52)$$

$$x_{M4}(t)\cos 2\theta = 2\left(\frac{c}{\sqrt{2}j\omega d}\right)^2 \left\{x_{M3}(t) - x_{M7}(t) - x_{M1}(t) + x_{M5}(t)\right\} \quad \cdots (53)$$

$\phi = \theta + 45°$

MICROPHONE APPARATUS

CROSS REFERENCES TO RELATED APPLICATIONS

The present invention contains subject matter related to Japanese Patent Application JP 2005-048542 filed in the Japanese Patent Office on Feb. 24, 2005, the entire contents of which are incorporated herein by reference.

BACKGROUND OF THE INVENTION

1. Field of the Invention

The present invention relates to a microphone apparatus.

2. Description of the Related Art

In a videoconference, for example, generally, speech of speakers is picked up by a microphone on a table. The microphone may also pick up ambient noise, and an unclear speech signal may be output from the microphone. There are methods for picking up speech of speakers by using a microphone in order to obtain a clear speech signal.

A first method is to use a directional microphone and to give emphasis on speech while suppressing noise when the speech is input to the microphone. A second method is to adaptively process a speech signal output from a microphone to reduce noise components. The first and second methods relatively reduce the level of the noise components included in the speech signal, thereby obtaining a clear speech signal.

A microphone apparatus employing the first method includes six microphones disposed around a reference microphone (microphone unit), in which the outputs of the microphones are combined using a Fourier transform so that the overall microphone apparatus provides unidirectional performance.

This microphone apparatus is disclosed in Japanese Unexamined Patent Application Publication No. 2002-271885.

SUMMARY OF THE INVENTION

The above-described microphone apparatus combines the outputs of the microphones by determining the value of the first-order approximation term in the Fourier transform under the assumption of a single sound source and by deriving the value of the third-order approximation term from the first-order approximation term. Although the microphone apparatus provides unidirectional performance, the directional range (i.e., angular range in which gain can be obtained) is as wide as about ±60° off the main axis.

However, such a wide directional range makes it difficult to achieve the desired effects of a directional microphone in an environment where a plurality of sound sources or a noise source exists.

It is therefore desirable to provide a unidirectional microphone apparatus with a narrow directional range in which the direction of the directivity is electrically variable.

According to an embodiment of the present invention, a microphone apparatus for processing and outputting an output signal of a microphone array including at least nine microphones includes a directivity function processing circuit that converts the output signal of the microphone array into a unidirectional signal and that outputs the unidirectional signal, wherein the directivity function processing circuit expands a directivity function whose variable is an incident angle of an acoustic wave into a Fourier series up to at least third order, and the variable in the expanded expression is produced from output signals of the microphones forming the microphone array.

Therefore, the microphone apparatus has sharp unidirectional characteristics, and the directional direction of the microphone apparatus can be varied.

BRIEF DESCRIPTION OF THE DRAWINGS

FIG. 1 is a diagram showing a directivity function of a microphone;

FIGS. 2A and 2B are characteristic diagrams showing the directivities of microphones;

FIG. 3 is a characteristic diagram for analyzing the directivity of a unidirectional microphone;

FIG. 4 is a diagram showing an analysis result of the directivity of the unidirectional microphone;

FIG. 8 is a diagram showing a portion of the directivity function;

FIG. 9 is a diagram showing a portion of the directivity function;

FIG. 10 is a diagram showing a portion of the directivity function;

FIG. 11 is a diagram showing a portion of the directivity function;

FIG. 12 is a diagram showing a portion of the directivity function;

FIG. 13 is a diagram showing a portion of the directivity function;

FIG. 14 is a diagram showing a directivity function according to an embodiment of the present invention;

FIG. 19 is a diagram showing a portion of the directivity function; and

DESCRIPTION OF THE PREFERRED EMBODIMENTS

Directivity Function

A microphone is a converter for converting an acoustic wave output from a sound source into a speech signal (audio signal), and has a predetermined transfer characteristic with respect to the direction, frequency, etc., of the input acoustic wave.

The characteristic of the microphone is given by Eq. (1) shown in FIG. 1. The transfer characteristic $D(\theta, \omega)$ is a function that varies depending on the direction $\theta$ and the angular frequency $\omega$ of the input acoustic wave, and represents the directivity of the microphone. The transfer characteristic $D(\theta, \omega)$ is generally referred to as a "directivity function". Thus, the directivity function represents the directivity of the microphone.

For example, a non-directional (omnidirectional) microphone has a directivity pattern shown in FIG. 2A, and the directivity function is given as follows:

$$D(\theta, \omega)=1$$

A bidirectional microphone has a directivity pattern shown in FIG. 2B, and the directivity function is given as follows:

$$D(\theta, \omega)=\cos\theta$$

Eq. (1) is satisfied when a single sound source exists. When N sound sources exist, Eq. (1) is satisfied for each of the sound sources, and the characteristic of the microphone is therefore given by Eq. (2) shown in FIG. 1.

Analysis of Unidirectional Microphone

FIG. 3 shows an ideal directivity function (directivity) of a unidirectional microphone. The following definitions are used:

$\theta$: direction (angle) of sound source with respect to microphone $\theta_c$: directional direction (direction of directional microphone)

$\theta_w$: directional range (angular range in which predetermined gain can be obtained).

The illustrated characteristic is regarded as a directivity function with respect to the variable $\theta$, and can be written in terms of a Fourier series as given by Eq. (3) shown in FIG. 4. Expanding Eq. (3), using the approximation expression up to n=3, leads to Eq. (4) shown in FIG. 4.

Figure 5A:
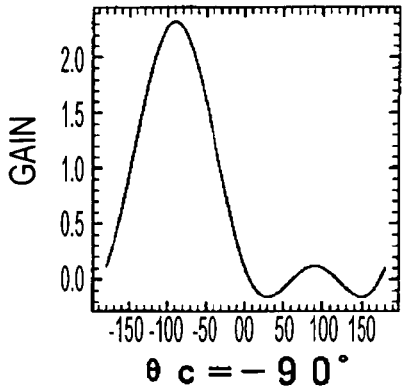
FIGS. 5A to 5C are characteristic diagrams showing the directivity of the unidirectional microphone.
Figure 5B:
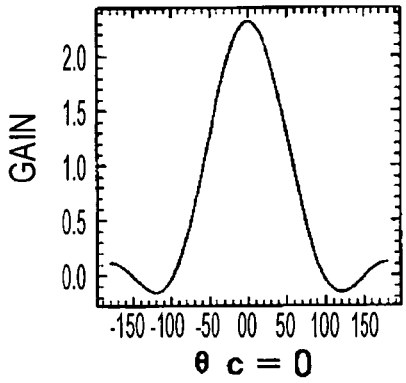
Figure 5C:
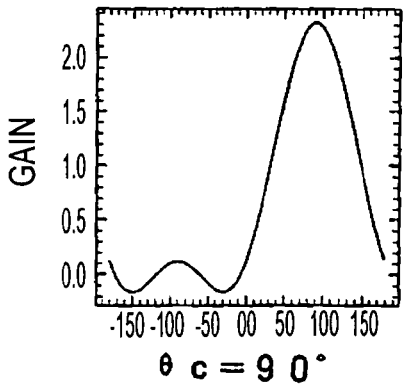

In Eq. (4) , by setting, for example, $\theta_w$=60° and changing the directional direction $\theta_c$, directional characteristics shown in FIGS. 5A to 5C are obtained. A microphone with a directivity function satisfying Eq. (4) provides relatively sharp directivity as shown in FIGS. 5A to 5C, and the directional direction $\theta_c$ can be arbitrarily varied.

Creation of Directivity Function

Figures 6, 7:
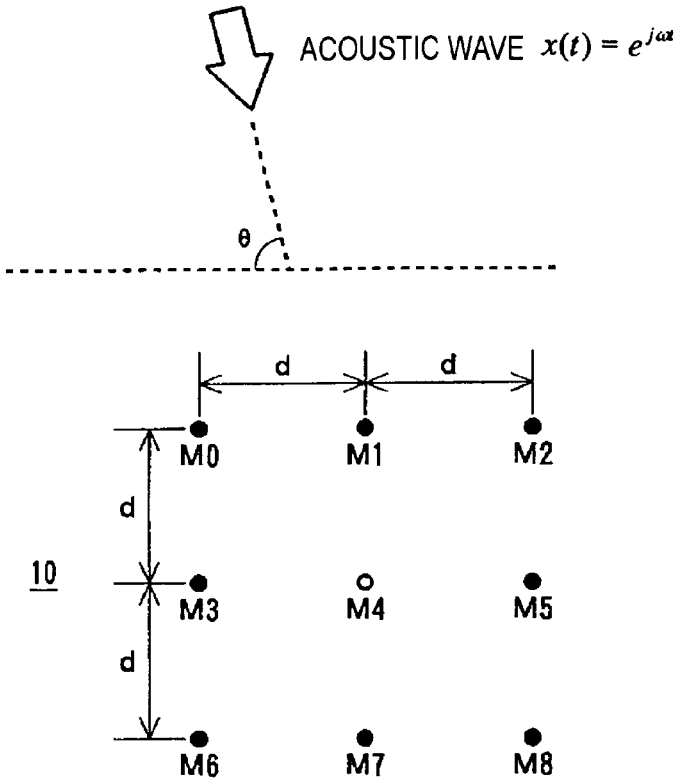
FIG. 6 is a layout diagram of a microphone array according to an embodiment of the present invention.
FIG. 7 is a diagram showing a directivity function of the unidirectional microphone using an approximation expression.

Referring to FIG. 6, nine microphones (microphone units) M0 to M8 are arranged in an array of three rows and three columns on the same plane to form a microphone array 10. The microphones M0 to M8 are non-directional. The microphones M0 to M8 are equally spaced in both the row and column directions with a distance d therebetween. The microphone M4 disposed at the center is the reference microphone. For example, the microphones M0 to M8 are pressure-type electret condenser microphones, and the distance d is 21 mm.

A sound source (not shown) is located in a plane including the microphone array 10. The distance between the sound source and the reference microphone M4 is represented by R, and the incident angle of the acoustic wave with respect to the microphones M0 to M8, or the directional direction, is represented by $\theta$. The distance R is greater than the distance d between the microphones M0 to M8. The incident angle $\theta$ has any value. In FIG. 6, the incident angle $\theta$ is zero in the row direction of the microphones M0 to M8.

The acoustic wave output from the sound source is given by Eq. (5) shown in FIG. 7. The output signal of the microphone Mi (i=0 to 8) is represented by $x_{Mi}(t)$.

In the microphone array 10, Eq. (1) is applied to the reference microphone M4. By substituting Eq. (3) in Eq. (1) and modifying the equation, Eq. (6) shown in FIG. 7 is obtained. As in Eq. (4), Eq. (6) is written by using the approximation up to n=3.

According to Eq. (6), the microphone array 10 has directivity, for example, as shown in FIGS. 5A to 5C, if $\cos\theta$, $\cos 2\theta$, $\cos 3\theta$, $\sin\theta$, $\sin 2\theta$, and $\sin 3\theta$ are determined. By changing the Fourier coefficients $a_0$ to $a_3$ and $b_1$ to $b_3$ depending on the values $\theta_c$ and $\theta_w$, the directional direction can be varied in the manner shown in FIGS. 5A to 5C.

Method for Determining $\cos\theta$, $\cos 2\theta$, $\cos 3\theta$, $\sin\theta$, $\sin 2\theta$, and $\sin 3\theta$ The values of $\cos\theta$, $\cos 2\theta$, $\cos 3\theta$, $\sin\theta$, $\sin 2\theta$, and $\sin 3\theta$ that are needed in Eq. (6) are determined from the output signals of the microphones M0 to M3 and M5 to M8, which will be described in detail below.

Case of $\cos\theta$

As shown in FIG. 8, when the acoustic wave output from the sound source is input to the microphones M3, M4, and M5 in the middle row of the microphone array 10, if the acoustic wave output from the sound source is given by Eq. (5) shown in FIG. 7, path length differences shown in FIG. 8 occur between the sound source and the microphones M3 to M5. The output signals of the microphones M3 to M5 are given by Eq. (7) shown in FIG. 8. In Eq. (7), the path length differences are based on the distance R between the sound source and the reference microphone M4.

The difference between the output signal of the microphone M3 and the output signal of the microphone M5 is given by Eq. (8) shown in FIG. 8. When the relation of the approximation expression $\sin\alpha=\alpha$ is applied to Eq. (8), Eq. (8) can be changed to Eq. (9) shown in FIG. 8, and Eq. (9) is modified into Eq. (10). According to Eq. (10), the value of $\cos\theta$ is obtained by performing arithmetic processing on the output signals of the microphones M3 and M5.

If the microphone M4 is assumed to be located at the center between the microphones M3 and M5, it is understood according to Eq. (10) that the output signal of the microphone M4 can be generated from the output signals of the microphones M3 and M5. Furthermore, Eq. (10) shows that the bidirectional characteristic shown in FIG. 2B is obtained by performing arithmetic processing on the output signals of the microphones M3 and M5.

Case of $\sin\theta$

As shown in FIG. 9, when the acoustic wave output from the sound source is input to the microphones M1, M4, and M7 in the middle column of the microphone array 10, path length differences shown in FIG. 9 occur between the sound source and the microphones M1, M4, and M7. The output signals of the microphones M1, M4, and M7 are given by Eq. (11) shown in FIG. 9. In Eq. (11), the path length differences are based on the distance R between the sound source and the reference microphone M4.

The difference between the output signal of the microphone M1 and the output signal of the microphone M7 is given by Eq. (12) shown in FIG. 9. When the relation of the approximation expression $\sin\alpha=\alpha$ is applied to Eq. (12), Eq. (12) can be changed to Eq. (13) shown in FIG. 9, and Eq. (13) is modified into Eq. (14).

According to Eq. (14), the value of $\sin\theta$ is obtained by performing arithmetic processing on the output signals of the microphones M1 and M7. Furthermore, Eq. (14) shows that the bidirectional characteristic in which the bidirectional characteristic shown in FIG. 2B is shifted by 90° is obtained by performing arithmetic processing on the output signals of the microphones M1 and M7.

Case of $\cos 2\theta$

Eq. (10) also shows that the output signal of the microphone M3 and the output signal of the microphone M5 are used to determine the output signal of the microphone M4 at the center therebetween.

As shown in FIG. 10, a virtual microphone V3 is provided at the center between the microphones M3 and M4 and a virtual microphone V5 is provided at the center between the microphones M4 and M5.

The output signals of the virtual microphones V3 and V5 are given by Eqs. (15) and (16) shown in FIG. 10 by a similar procedure of deriving Eq. (10), respectively. The difference between Eqs. (15) and (16) is given by Eq. (17) shown in FIG. 10. Eq. (18) shown in FIG. 10 is derived from Eq. (17) using a similar procedure of deriving Eq. (10) from Eq. (8).

Substituting Eq. (18) in Eq. (17) and rearranging the terms lead to Eq. (19). By applying a double-angle identity, which is given by Eq. (20) shown in FIG. 10, to Eq. (19), Eq. (21) shown in FIG. 10 is obtained. Eq. (21) is modified into Eq. (22) shown in FIG. 10.

According to Eq. (22), the value of cos 2θ is obtained by performing arithmetic processing on the output signals of the microphones M3 to M5.

Case of sin 2θ

A similar procedure of determining cos 2θ is used to determine sin 2θ. Specifically, as shown in FIG. 11, a virtual microphone V3 is provided at the center between the microphones M0 and M6, and a virtual microphone V5 is provided at the center between the microphones M2 and M8.

The output signals of the virtual microphones V3 and V5 are given by Eqs. (23) and (24) shown in FIG. 11 by a similar procedure of deriving Eq. (14), respectively. The difference between Eqs. (23) and (24) is given by Eq. (25) shown in FIG. 11. Eq. (26) shown in FIG. 11 is derived from Eq. (25) using a similar procedure of deriving Eq. (10) from Eq. (8).

Substituting Eq. (26) in Eq. (25) and rearranging the terms lead to Eq. (28). By applying a double-angle identity, which is given by Eq. (27) shown in FIG. 11, to Eq. (28), Eq. (29) shown in FIG. 11 is obtained.

According to Eq. (29), the value of cos 2θ is obtained by performing arithmetic processing on the output signals of the microphones M0, M2, M6, and M8.

Case of cos 3θ

As shown in FIG. 12, a virtual microphone V0 is provided at the center between the microphones M0 and M3, a virtual microphone V6 is provided at the center between the microphones M3 and M6, and a virtual microphone V3 is provided at the position of the microphone M3. Further, a virtual microphone V2 is provided at the center between the microphones M2 and M5, a virtual microphone V8 is provided at the center between the microphones M5 and M8, and a virtual microphone V5 is provided at the position of the microphone M5.

The output signals of the virtual microphones V0 and V6 are given by Eqs. (30) and (31) shown in FIG. 12 by a similar procedure of deriving Eq. (14), respectively. The difference between Eqs. (30) and (31) is given by Eq. (32) shown in FIG. 12. Eq. (33) shown in FIG. 12 is derived from Eq. (32) using a similar procedure of deriving Eq. (10) from Eq. (8). Substituting Eq. (33) in Eq. (32) and rearranging the terms lead to Eq. (34). Likewise, Eq. (35) is obtained for the virtual microphones V2, V8, and V5.

A virtual microphone V4 is provided at the position of the microphone M4, and the output signal of the virtual microphone V4 is determined from Eqs. (34) and (35), thereby obtaining Eq. (36) shown in FIG. 12. Substituting Eqs. (36) and (10) in a triple-angle identity, which is given by Eq. (37) shown in FIG. 12, leads to Eq. (38) shown in FIG. 12.

According to Eq. (38), the value of cos 3θ is obtained by performing arithmetic processing on the output signals of the microphones M0, M2, M3, M5, M6, and M8.

Case of sin 3θ

As shown in FIG. 13, virtual microphones V3, V4, and V5 are provided at the positions of the microphones M3, M4, and microphone M5, respectively.

The output signals of the virtual microphones V3, V4, and V5 are given by Eqs. (39), (40), and (41) shown in FIG. 13 by a similar procedure of deriving Eq. (10), respectively.

Further, a virtual microphone Va is provided at the center between the virtual microphones V3 and V4, and a virtual microphone Vb is provided at the center between the virtual microphones V4 and V5. The output signals of the virtual microphones Va and Vb are given by Eqs. (42) and (43) shown in FIG. 13 by a similar procedure, respectively. The output signal of the virtual microphone V4 is determined from the signals given by Eqs. (42) and (43), thereby obtaining Eq. (44) shown in FIG. 13.

Substituting Eqs. (44) and (14) in a triple-angle identity, which is given by Eq. (45) shown in FIG. 13, leads to Eq. (46) shown in FIG. 13.

According to Eq. (46), the value of sin 3θ is obtained by performing arithmetic processing on the output signals of the microphones M0 to M3 and M5 to M8.

Synthesis of Microphone Outputs

By replacing cos θ, cos 2θ, cos 3θ, sin θ, sin 2θ, and sin 3θ in Eq. (6) with Eqs. (10) , (22), (38), (14), (29), and (46), respectively, Eq. (47) shown in FIG. 14 is obtained. According to Eq. (47), it is understood that the output signal of the reference microphone M4 is combined with the output signals of the remaining microphones M0 to M3 and M5 to M8, thereby achieving relatively sharp directivity (directivity function) as shown in FIGS. 5A to 5C, and that the directional direction $\theta_c$ can be arbitrarily varied.

In Eq. (47), some terms are multiplied by 1/(jω). This arithmetic operation is carried out by performing a Fourier transform on the corresponding signals into the frequency domain. Specifically, the multiplication of 1/j means that the phase of the speech signal component at each frequency is advanced by 90°. In the actual arithmetic operation, the speech signal component in each band after the Fourier transform is processed so that the value of the imaginary part is replaced with the value of the real part and the value of the real part is replaced with the value of the imaginary part by inverting the sign of the real part.

The multiplication of 1/ω causes the amplitude (level) of the signal component to change depending on the frequency (ω/2π), and the amplitude is also compensated.

Embodiment

Figure 15:
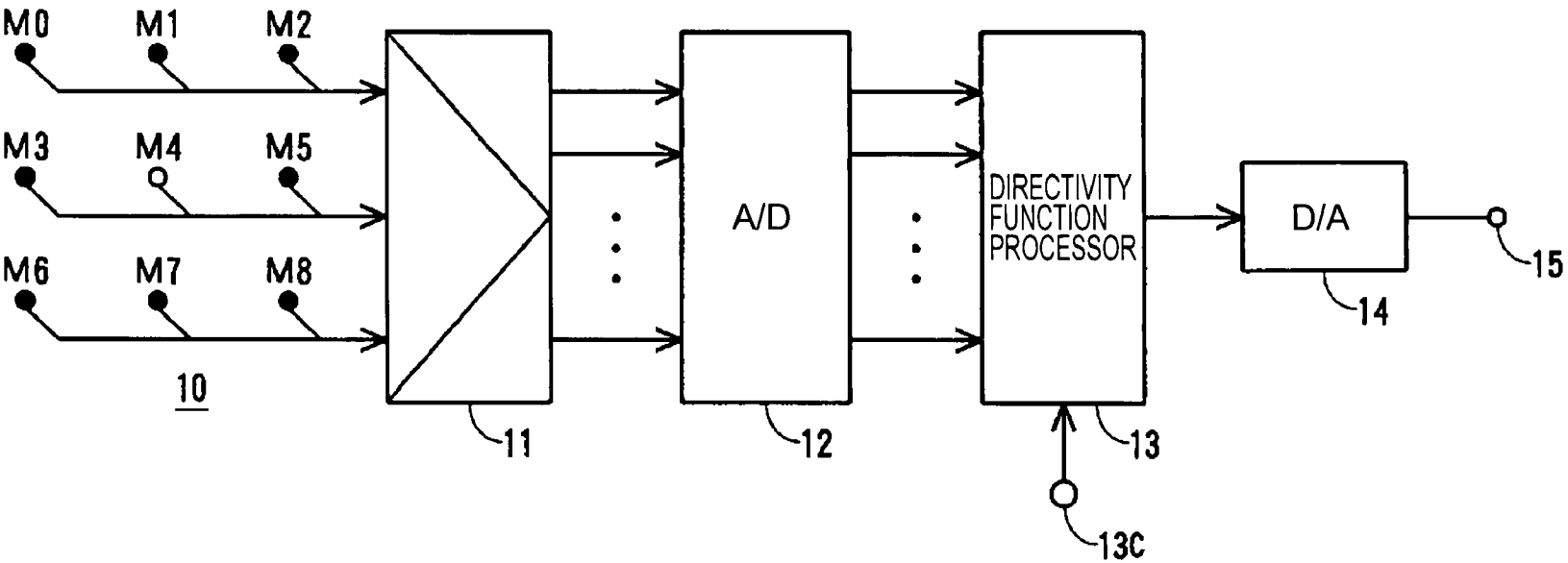
FIG. 15 is a block diagram of a microphone apparatus according to an embodiment of the present invention.

FIG. 15 shows a microphone apparatus according to an embodiment of the present invention. The microphone apparatus is configured such that the directional range $\theta_w$ is narrow and the directional direction $\theta_c$ is variable according to the concept described above.

The microphone apparatus includes a microphone array 10 having the structure shown in FIG. 6. The output signals of the microphones M0 to M8 are supplied to a nine-channel analog-to-digital (A/D) converter circuit 12 through a nine-channel microphone amplifier 11, and are A/D converted into digital signals. The digital signals are supplied to a directional function processing circuit 13, and the process given by Eq. (47) is performed to extract a signal y(t). The details of the processing method will be described below.

The output signal y(t) is supplied to a digital-to-analog (D/A) converter circuit 14, and is D/A converted into an analog signal. The analog signal is transmitted to an output terminal 15 as a microphone output.

The directivity function processing circuit 13 is composed of, for example, a microcomputer, and is connected with an operation key 13C. When the directional direction $\theta_c$ and the directional range $\theta_w$ are specified through the operation key 13C, the Fourier coefficients $a_0$ to $a_3$ and $b_1$ to $b_3$ corresponding to the specified directional direction $\theta_c$ and directional range $\theta_w$ are generated and used in Eq. (47). In the processing circuit 13, therefore, the output signals of the microphones M0 to M8 provide a characteristic corresponding to the specified directional direction $\theta_c$ and directional range $\theta_w$, and are combined into the signal given by Eq. (47).

The apparatus shown in FIG. 15 is therefore a microphone apparatus whose directional range $\theta_w$ is narrow and whose directional direction $\theta_c$ is variable. Further, according to Eq. (47), the parameters needed for the computation are merely the output signals of the microphones M0 to M8 and the values for defining a directional characteristic (i.e., the values indicating the directional direction $\theta_c$ and the directional range $\theta_w$). The directivity can be determined if the direction from which the acoustic wave arrives is unknown.

Figure 16A:
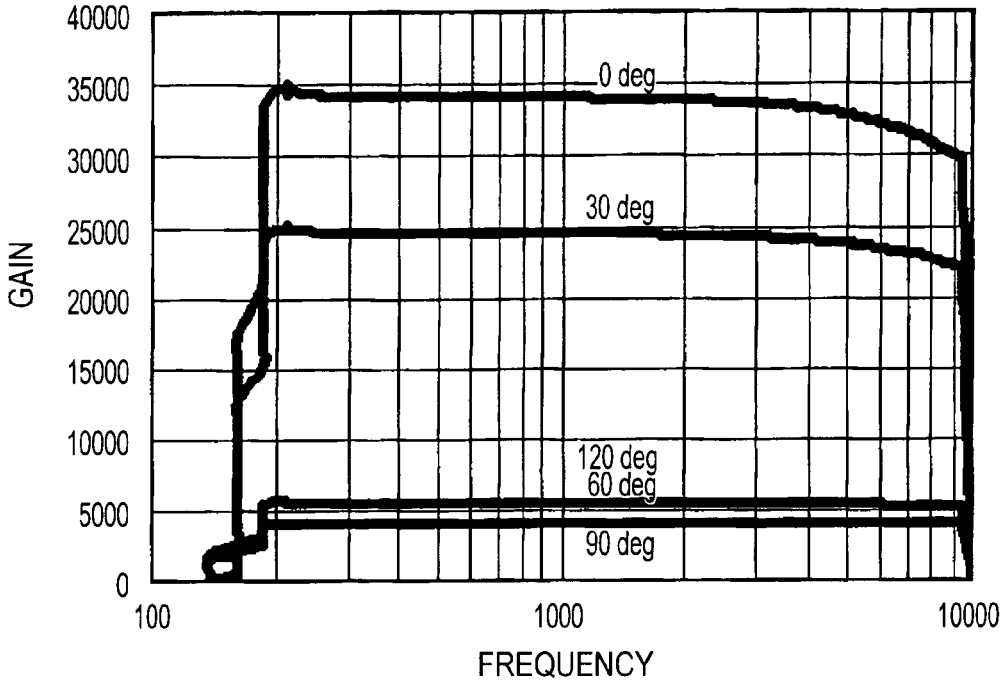
FIGS. 16A and 16B are characteristic diagrams of the microphone apparatus according to the embodiment of the present invention and a microphone apparatus of the related art.
Figure 16B:
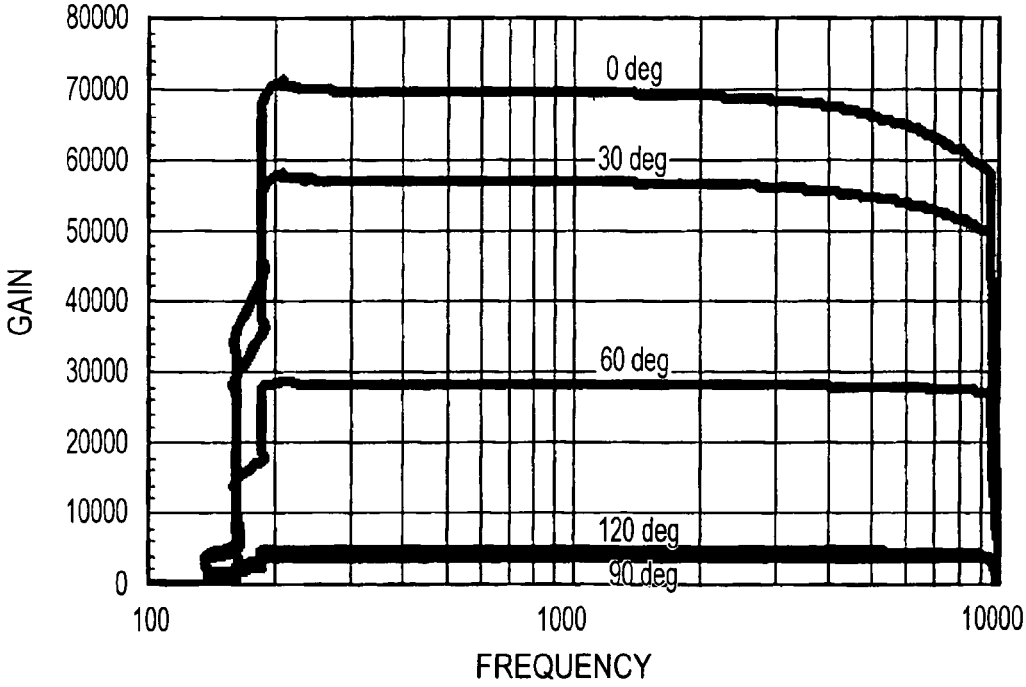
Figure 17A:
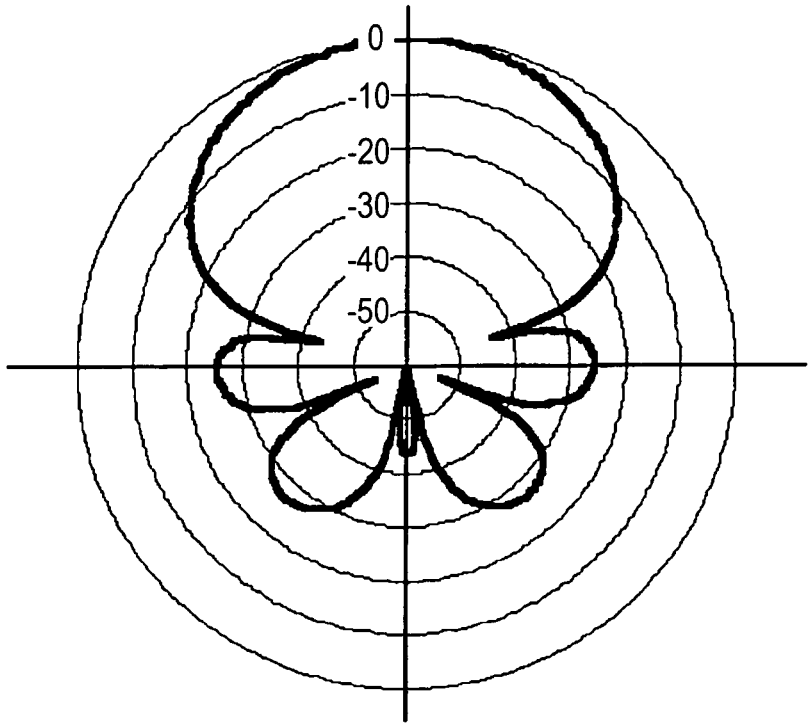
FIGS. 17A and 17B are characteristic diagrams of the microphone apparatus according to the embodiment of the present invention and a microphone apparatus of the related art.
Figure 17B:
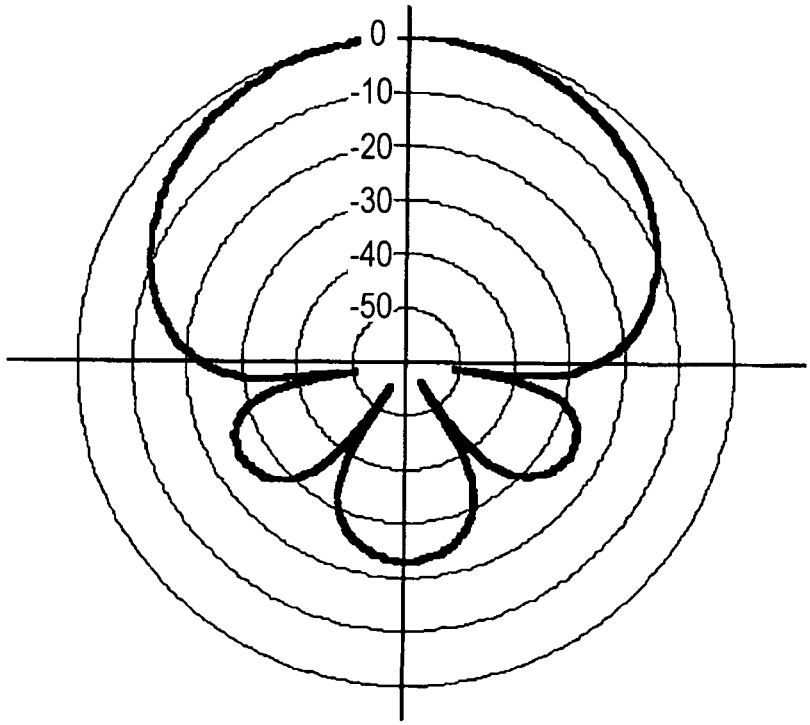

FIGS. 16A and 17A show the simulation of the directivity of the microphone apparatus according to the embodiment of the present invention, and FIGS. 16B and 17B show the simulation of the directivity of the microphone apparatus of the related art disclosed in Japanese Unexamined Patent Application Publication No. 2002-271885 noted above. As is apparent from FIGS. 16A and 16B, the frequency characteristics are substantially flat in the main frequency band. In FIGS. 17A and 17B, patterns at an acoustic wave frequency of 1.5 kHz, by way of example, are illustrated.

As can be seen from FIGS. 16A to 17B, the microphone apparatus according to the embodiment of the present invention (the characteristics shown in FIGS. 16A and 17A) provides better directivity as a unidirectional microphone than the microphone apparatus of the related art (the characteristics shown in FIGS. 16B and 17B). In particular, in the range of $\theta<-60°$ or $\theta>60°$, acoustic waves from the corresponding directions are considerably suppressed.

Details of Operation of Directivity Function Processing Circuit

Figure 18:
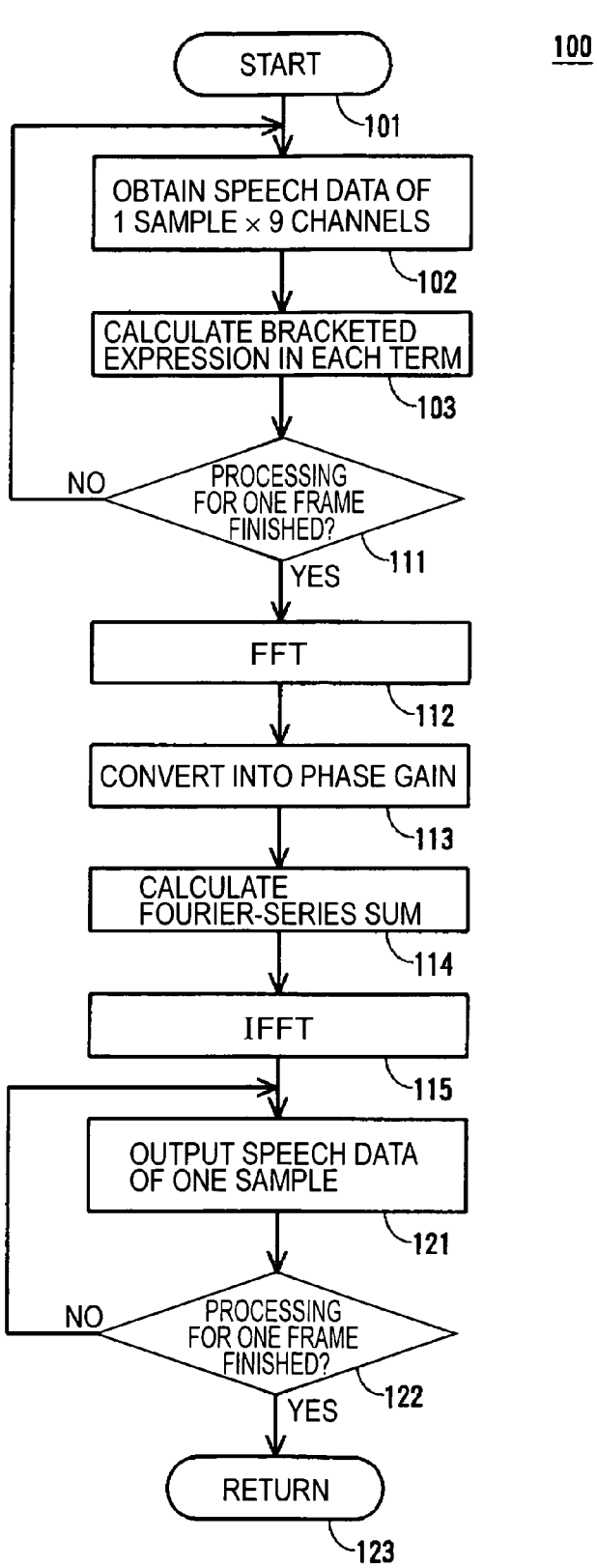
FIG. 18 is a flowchart showing an exemplary routine for obtaining the directivity function shown in FIG. 14.

The directivity function processing circuit 13 executes a routine 100 shown in FIG. 18 to perform the process given by Eq. (47). In this embodiment, one frame of speech signal includes 2048 samples.

The routine 100 starts from step 101. In step 102, the output signals of the microphones M0 to M8, that is, the speech data output from the A/D converter circuit 12, which correspond to nine-channel data for a sample, are input. In step 103, the sums and differences in the bracketed expressions in Eq. (47) are calculated. For example, in the term in the third line of Eq. (47) (i.e., the term corresponding to Eq. (10)), the expression $\{x_{M3}(t)-x_{M5}(t)\}$ is calculated.

In step 111, it is determined whether or not the processing of steps 102 and 103 for the period of one frame has been performed, and, if not, the routine 100 returns to step 102.

If the processing of steps 102 and 103 for the period of one frame has been performed, the routine 100 proceeds from step 111 to step 112. In step 112, the calculation results determined in step 103 are converted into frequency-domain data by performing a fast Fourier transform (FFT). In step 113, coefficients of the bracketed expressions in Eq. (47) are phase-converted. For example, in the term in the third line of Eq. (47) (i.e., the term corresponding to Eq. (10)), the coefficient of the expression $\{x_{M3}(t)-x_{M5}(t)\}$ is $c/(2j\omega d)$, and the value $c/(2\omega d)$ is calculated, and is converted into the value of the imaginary part.

In step 114, the Fourier coefficients $a_0$ to $a_3$ and $b_1$ to $b_3$ corresponding to the desired directivity are multiplied by the values determined in steps 103 and 113, and the Fourier-series sum is calculated to determine the value given by Eq. (47). In step 115, the determined value is subjected to inverse fast Fourier transform (IFFT) processing, and is converted into time-domain data.

In step 121, the data converted in step 115 is supplied to the D/A converter circuit 14 for every period of one sample on a sample-by-sample basis. In step 122, it is determined whether or not the processing of step 121 for the period of one frame has been performed, and, if not, the routine 100 returns to step 121.

If the processing of step 121 for the period of one frame has been performed, the routine 100 proceeds from step 122 to step 123. In step 123, the process for the period of one frame ends.

According to the routine 100, the process given by Eq. (47) is performed. In the routine 100, the values in the bracketed expressions are calculated for each sample in step 103 before the FFT is performed in step 112. The process can therefore be properly and smoothly carried out.

Another Method for Determining cos 2θ

Figure 20A:
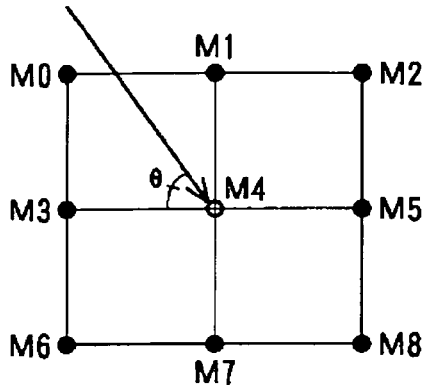
FIG. 20 is a diagram showing a portion of the directivity function.
Figure 20B:
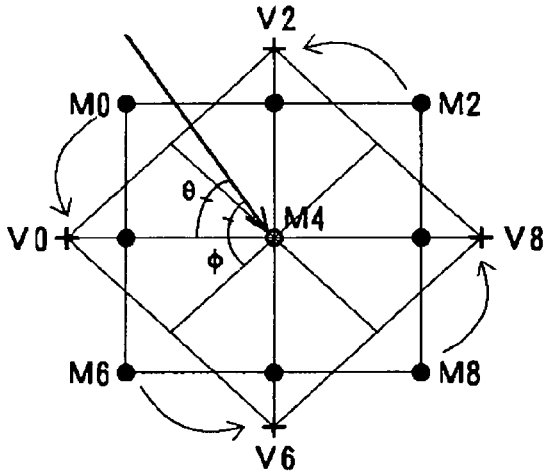
Figure 20C:
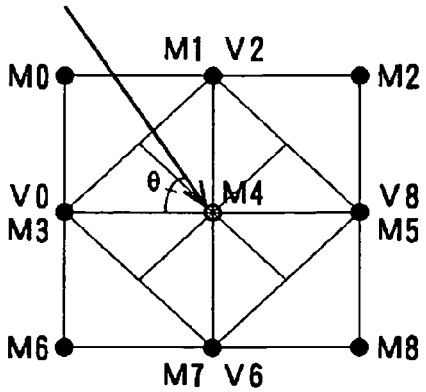

FIGS. 19 to 20C show another method for determining cos 2θ. Specifically, cos 2θ can be modified as given by Eq. (48) shown in FIG. 19. If the angles θ and ϕ satisfy the relation given by Eq. (49) shown in FIG. 19, Eq. (48) is equivalent to Eq. (50) shown in FIG. 19.

As shown in FIGS. 20A and 20B, virtual microphones V0, V2, V6, and V8 are provided at the positions where the microphones M0, M2, M6, and M8 are rotated by 45° (=ϕ−θ) with respect to the reference microphone M4 in the direction in which the incident angle θ decreases. In this case, the incident angle of the acoustic wave with respect to the virtual microphones V0, V2, V6, and V8 is equal to the angle ϕ according to the relation given by Eq. (49).

The relationship between the acoustic wave with the incident angle ϕ and the output signals of the virtual microphones V0, V2, V6, and V8 is equivalent to the relationship between the acoustic wave with the incident angle θ and the output signals of the microphones M0, M2, M6, and M8. Thus, the output signals of the virtual microphones V0, V2, V6, and V8 are processed by a similar procedure to that of Eq. (29) (which is also shown in FIG. 19) to yield the signal given by Eq. (51) shown in FIG. 19.

As shown in FIG. 20C, the positions of the virtual microphones V0, V2, V6, and V8 are shifted toward the reference microphone M4 so as to be located at the positions of the microphones M3, M1, M7, and M5, respectively. In this case, the output signals of the virtual microphones V0, V2, V6, and V8 are equivalent to the output signals of the microphones M3, M1, M7, and M5, respectively. The distance between the virtual microphones V0, V2, V6, and V8 has a value of 2d in FIG. 20B; whereas, in FIG. 20C, the difference has a value of $\sqrt{2}\cdot d$. In the case of FIG. 20C, therefore, Eq. (51) is changed to Eq. (52) shown in FIG. 19.

Substituting Eq. (50) in Eq. (52) leads to Eq. (53) shown in FIG. 19. It is therefore possible to calculate Eq. (47) using Eq. (53).

Other Embodiments

For example, in Eq. (10), the difference signal between the output signal of the microphone M3 and the output signal of the microphone M5 is obtained in the bracketed expression. When the distance d between the microphones M0 to M8 is small, if the frequency of the input acoustic wave is low, the difference between the acoustic wave input to the microphone M3 and the acoustic wave input to the microphone M5 is small and the level of the difference signal obtained in Eq. (10) becomes low.

When the distance d is large, if the frequency of the input acoustic wave is high, the path length difference between the acoustic wave input to the microphone M3 and the acoustic wave input to the microphone M5 is one wavelength or more, and the process given by Eq. (10) is not proper.

The same applies to the difference signal or sum signal of the output signals of the microphones M0 to M8, resulting in low arithmetic precision in Eq. (47). It can therefore be difficult to obtain the desired directivity.

In such a case, two microphone arrays 10 are used. The distance d between microphones differs from one of the microphone arrays to the other, and the reference microphone disposed at the center is shared. The low-frequency component of the speech signal is extracted from the microphone array having a larger distance between the microphones, and the high-frequency component of the speech signal is extracted from the microphone array having a smaller distance. The signal obtained by summing the extracted components is subjected to the process given by Eq. (47), thereby achieving high directivity over a wide band.

In the above-described microphone apparatus, it is difficult to suppress noise arriving from the same direction as that of the target acoustic wave. In this case, for example, the output signal of the directivity function processing circuit 13 is adaptively processed to suppress the noise signal. In a case where noise is included in speech of speakers in a videoconference or the like, therefore, the noise can be suppressed to obtain a clear speech signal.

Further, first, the direction of a sound source can be detected, and, then, the directional direction $\theta_c$ and the directional range $\theta_w$ can be set again according to the detected direction, thereby emphasizing a target signal or suppressing an unnecessary signal. That is, the directivity function can be set so that sound in a specific direction can or cannot be picked up. Alternatively, a plurality of microphone arrays 10 may be arranged on the same plane so that the directional directions of the microphone arrays 10 are directed to a specific point, thereby emphasizing sound from a sound source located at the specific point.

Furthermore, it is possible to pick up clearer target sound by setting the directional direction to the target sound direction and the noise sound direction and subtracting the signal in the noise sound direction from the signal in the target sound direction. It is also possible to predict and remove acoustic waves input irrespective of the directional direction, such as noise from the vertical direction.

Moreover, a microphone array having a function, such as an echo canceller, may be used. In this case, impulse responses of the echo canceller are separately learned as information for the array outputs with individual directivities in, for example, 5°-step directional directions, thereby rapidly removing echo of the speech in the direction to which the microphone is directed. Alternatively, impulse responses of the echo canceller may be separately learned as information for, for example, eight directions, and the impulse response in a direction close to the direction to which the microphone is to be directed among the eight directions may be used as the initial value. In this case, the total amount of arithmetic operations can be reduced, and the residual echo can be reduced compared with the computation from the completely initial value.

It should be understood by those skilled in the art that various modifications, combinations, sub-combinations and alterations may occur depending on design requirements and other factors insofar as they are within the scope of the appended claims or the equivalents thereof.

What is claimed is:

1. A microphone apparatus for processing and outputting an output signal, comprising:

a microphone array including at least nine microphones; and a directivity function processing circuit configured to convert the output signals of the microphone array into a unidirectional signal using at least a third order Fourier series expansion of a predetermined directivity function, the directivity function processing unit outputting the unidirectional signal, an incident angle of an acoustic wave being used to generate Fourier coefficients for the third order Fourier series expansion, the Fourier series coefficients determining a directivity direction and directivity range of the predetermined directivity function, wherein the incident angle is determined from the output signals of the at least nine microphones forming the microphone array.

2. The microphone apparatus according to claim 1, wherein the microphones forming the microphone array are non-directional.

3. The microphone apparatus according to claim 1, wherein the microphones in the microphone array are arranged in an array of three rows and three columns in a same plane.

4. The microphone apparatus according to claim 3, wherein a microphone located at a center among the microphones forming the microphone array comprises a reference microphone, and an output signal of the reference microphone and the output signals of the remaining microphones are combined to obtain the unidirectional signal.

5. The microphone apparatus according to claim 1, wherein the directional function processing circuit performs an operation of calculating the output signals of the microphones forming the microphone array on a sample-by-sample basis, an operation of performing a fast Fourier transform on the calculated output signals for every period of one frame, an operation of performing phase processing on results of the fast Fourier transform and calculating a Fourier-series sum, and an operation of performing an inverse fast Fourier transform on the calculated sum and outputting an output signal for each sample.

6. A speech signal converting method for causing a microphone apparatus to process and output an output signal, comprising:

receiving, at a directivity function processor, output signals from a microphone array including at least nine microphones;

determining, in the directivity function processor, the incident angle based on the output signals of the microphones in the microphone array;

determining, in the directivity function processor, Fourier series coefficients for a directivity function based on the incident angle of acoustic waves relative to the microphone array;

expanding, in the directivity function processor, a directivity function into a third order Fourier series expansion thereof, the Fourier series coefficients determining a directivity direction and directivity range of the directivity function; and converting, in the directivity function processor, the output signals of the microphone array into a unidirectional signal using the third order Fourier series expansion of the directivity function and the incident angle.

* * * * *